US011754354B2

(12) United States Patent
Spork et al.

(10) Patent No.: US 11,754,354 B2
(45) Date of Patent: Sep. 12, 2023

(54) PROPELLANT PORTIONING DEVICE COMPRISING AN EXPANDABLE HOLDING ELEMENT

(71) Applicant: KRAUSS-MAFFEI WEGMANN GMBH & CO. KG, Munich (DE)

(72) Inventors: Roland Spork, Kassel (DE); Matthias Raczek, Kassel (DE); Matthias Czok, Kassel (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 46 days.

(21) Appl. No.: 17/439,923

(22) PCT Filed: Mar. 16, 2020

(86) PCT No.: PCT/DE2020/100197

§ 371 (c)(1),
(2) Date: Sep. 16, 2021

(87) PCT Pub. No.: WO2020/187364

PCT Pub. Date: Sep. 24, 2020

(65) Prior Publication Data

US 2022/0187039 A1 Jun. 16, 2022

(30) Foreign Application Priority Data

Mar. 18, 2019 (DE) ..... 102019106848.7

(51) Int. Cl.
*F41A 9/22* (2006.01)
*F41A 9/37* (2006.01)

(52) U.S. Cl.
CPC ..... *F41A 9/22* (2013.01); *F41A 9/375* (2013.01)

(58) Field of Classification Search
CPC .... F42B 39/22; F41A 9/09; F41A 9/37; F41A 9/375

(Continued)

(56) References Cited

U.S. PATENT DOCUMENTS 4,898,071 A * 2/1990 Borgwarth ..... F41A 9/01 414/676
5,107,751 A * 4/1992 Grabner ..... F41A 9/70 89/34

(Continued)

FOREIGN PATENT DOCUMENTS

DE 3545022 A1 6/1987
DE 3933098 A1 4/1991

(Continued)

OTHER PUBLICATIONS

European Patent Office (ISA/EP), International Search Report (with English translation), International Application No. PCT/DE2020/100197, 7 pages, dated Jun. 17, 2020.

(Continued)

*Primary Examiner* — John Cooper
(74) *Attorney, Agent, or Firm* — Thompson Hine LLP

(57) ABSTRACT

A propellant portioning device for a propellant formed from a plurality of individual propellant modules includes at least a first module holder, wherein the first module holder has at least one expandable holding element for holding one of the individual propellant modules. In an embodiment, the expandable holding element is expandable by a pressure of a fluid, wherein the fluid is introduced into an interior of the expandable holding element.

19 Claims, 4 Drawing Sheets

(58) Field of Classification Search
USPC ..... 89/45, 47
See application file for complete search history.

(56) References Cited

U.S. PATENT DOCUMENTS

| | | | | | |
|---|---|---|---|---|---|
| 5,144,789 | A | | 9/1992 | Focke et al. | |
| 5,336,040 | A | | 8/1994 | Focke et al. | |
| 5,458,044 | A | * | 10/1995 | Delbos | F41A 9/78 89/34 |
| 5,831,201 | A | * | 11/1998 | Andersson | F41A 9/375 89/47 |
| 5,837,923 | A | * | 11/1998 | Gay | F41A 9/09 89/46 |
| 7,140,300 | B2 | * | 11/2006 | Minard | F41A 9/375 89/46 |
| 2005/0241469 | A1 | * | 11/2005 | Minard | F41A 9/375 89/45 |

FOREIGN PATENT DOCUMENTS

| | | | | | |
|---|---|---|---|---|---|
| DE | 4435985 | A1 | | 5/1995 | |
| DE | 102004025743 | A1 | | 12/2005 | |
| DE | 102009058150 | A1 | | 6/2011 | |
| DE | 102011050282 | B3 | | 9/2012 | |
| DE | 102011055045 | A1 | | 5/2013 | |
| EP | 2332863 | A1 | | 6/2011 | |
| FR | 2743413 | A1 | * | 7/1997 | F41A 9/09 |
| FR | 2743413 | A1 | | 7/1997 | |

OTHER PUBLICATIONS (PCT) International Bureau of WIPO, International Preliminary Report on Patentability (English translation), International Application No. PCT/DE2020/100197, 9 pages, dated Sep. 30, 2021.

* cited by examiner

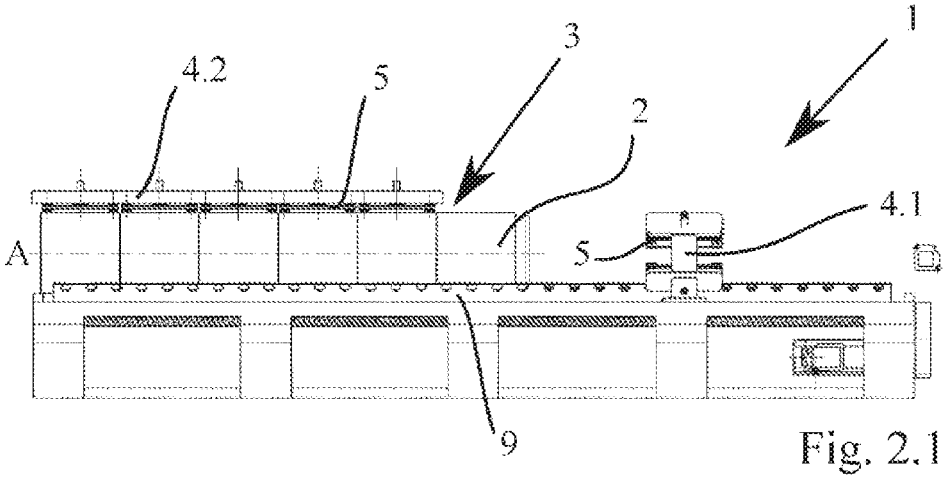
Fig. 2.1
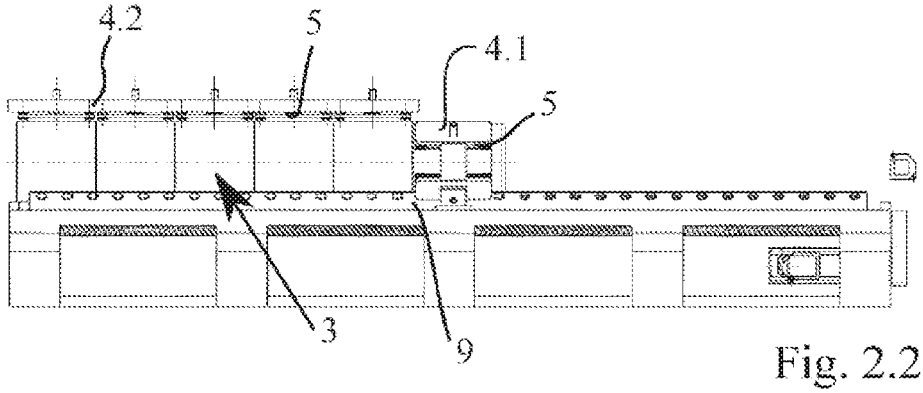
Fig. 2.2
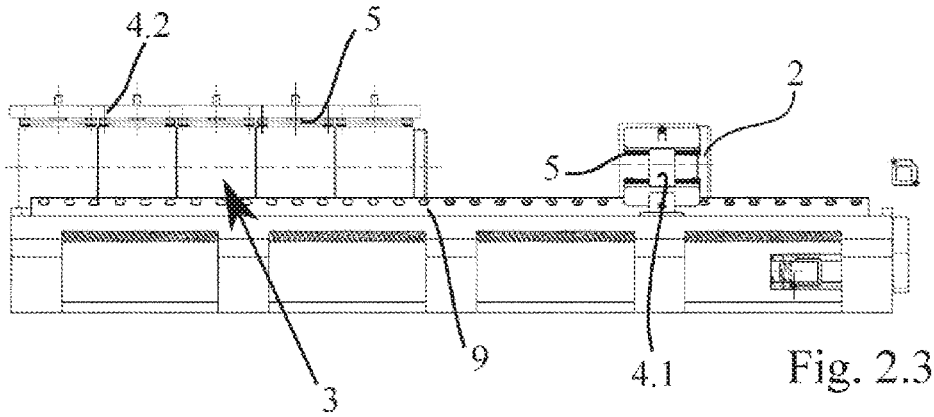
Fig. 2.3

PROPELLANT PORTIONING DEVICE COMPRISING AN EXPANDABLE HOLDING ELEMENT

TECHNICAL FIELD

The disclosure relates to a propellant portioning device for a propellant formed from a plurality of individual propellant modules with at least one module holder. The disclosure further relates to a method for portioning a propellant formed from a plurality of individual propellants by means of a propellant portioning device. Other subject matter of the disclosure describes an ammunition loading device and a military vehicle with a propellant portioning device.

BACKGROUND

The invention can be used primarily in the field of large-caliber weapon systems, such as battle tanks and artillery guns, in which the weapon is operated with split ammunition, i.e. consisting of the ammunition body to be fired and a separate propellant that can be ignited to accelerate the ammunition body. But the invention can also be used in the production and/or handling of propellants, for example. In contrast to cartridge ammunition, it is possible to vary the amount of propellant if necessary in the case of split ammunition, for example in order to adjust the firing range and thus also to be able to fire at more distant or closer targets.

The propellant is often composed of multiple propellant modules, which can be joined to each other by front and bottom joining areas to form differently sized propellants. Usually, propellants are produced by the manufacturer in the manner of combined propellant rods and transported in transport containers to the place of use. There it is necessary for further use to separate the propellant and to disassemble it into the individual propellant modules before they are stowed inside the weapon system, for example in a propellant magazine according to DE 10 2004 025 743 A1. If appropriate, a certain number of propellant modules is then joined together to form a propellant portion with the desired amount of propellant and—if, for example, no firing is carried out during maneuvers—they are then separated again.

For separation, the joined propellant modules can, for example, be placed on an edge and the propellant module to be separated then subjected to a force from above, whereby the push-in connection between the propellant modules is to be released by kinking.

The individual propellant modules usually consist of a thin outer skin, usually of a combustible material, which can be easily damaged when not joined properly or when separating the propellant modules. Since the propellant modules are also often very tightly pushed into each other due to manufacturing tolerances, it can lead to unwanted damage to the outer skin of the propellant modules during manual separation, which may lead to the fact that they can no longer be used.

In order to avoid such problems, devices are known with which the propellants in propellant modules can be separated into individual portions. Thus, DE 10 2011 055 045 A1 shows a propellant portioning device for the separation of propellants into propellant modules. The propellant portioning device has a plurality of module holders, by means of which a propellant can be held and divided into propellant modules. The module holders are arranged on a threaded spindle, by the actuation of which—since the module holders move at different movement speeds—a relative movement between the propellant modules is produced and the propellant modules can be separated in this way. A manual device for portioning is further shown in DE 10 2011 050 282 B3.

Such propellant portioning devices have proved themselves in the past. However, it has proved to be disadvantageous that the module holder must be matched to the geometries and/or the approved maximum radial forces of the propellant modules to be gripped, so that only a certain type of propellant modules can be separated and joined with a propellant portioning device.

SUMMARY

The disclosed propellant portioning device comprising an expandable holding element is therefore based on the object to provide a propellant portioning device, which allows improved handling of propellant modules.

This object is achieved with a propellant portioning device of the type mentioned above in that the module holder has at least one expandable holding element for holding a propellant module.

Due to an expandable holding element, a propellant module of a propellant can be reliably accommodated and held. By means of the expanding holding element, the holding force acting on the propellant module can be regulated as required. By expansion, the volume of the holding element can be increased and/or reduced as required, so that due to the arrangement on the module holder the holding element expands against the propellant and in particular against the propellant module and is thus held. In this way, reliable and safe handling of propellants can be carried out, in particular independently of geometric dimensions and/or material properties. The expandable holding element can adapt to the outer contour when holding the propellant.

A preferred design provides that the module holder can be adapted to different propellants to be held by means of the holding element. The propellant portioning device can be used in this respect with a wide variety of applications and/or propellants, wherein it is not necessary to use different module holders, each of which is matched to a specific application. The functionality of the propellant portioning device can thus be significantly increased. Thus, for example, by means of the expanding holding element a smaller diameter and/or a lower holding force can be adjusted if, for example, a smaller propellant is to be handled. In the case of a propellant with a larger diameter, however, a larger radius and/or a greater holding force can be adjusted by means of the expansion of the holding element and thus larger and/or heavier propellants can also be handled safely.

It is particularly preferred when the holding element can be expanded by the pressure of a fluid. In particular, the fluid can be introduced into the interior of the holding element. It has been found to be particularly advantageous when a gas, in particular compressed air, and/or a liquid, in particular hydraulic fluid, are used as a fluid. By introducing a predetermined amount of fluid into the holding element, the desired pressure can be produced inside the holding element and the holding element can be expanded and/or contracted to an advantageous size. The holding element may have a cavity inside it into which the fluid can be introduced. The holding element can thus be inflated by the fluid and can thereby expand.

In an advantageous manner, the pressure may be produced pneumatically and/or hydraulically.

In particular, the pressure can be produced by means of a pressure generator, such as a pump, a compressor, a manual handle or the like. Preferably, for this purpose the holding element and/or the module holder may have a pneumatic and/or hydraulic connection which can be connected to a line system. By the introduction and removal of the fluid, control of the pressure in the holding element can be carried out. The pneumatic and/or hydraulic connection may also have a valve by means of which the inflow of the fluid can be controlled. The valve may preferably be of a manual, electrical and/or magnetic design. It is particularly preferred when the valve is operated only from a predetermined response pressure and/or acts only in one direction. With a number of valves, each valve can also be activated individually and/or several valves can be activated together. With a plurality of connections, each connection can be activated individually, or all the connections can be activated.

According to a preferred embodiment of the invention, it is provided that the holding force can be adjusted by adapted pressurization of the holding element. Preferably, a high holding force can be produced by a high pressure inside the holding element and a lower holding force can be produced by a lower pressure inside the holding element. Thus, both relatively heavy but stable propellants can be held with a high holding force and sensitive, less stable propellants can be held with a lower holding force. The pressurization of the holding element can be carried out particularly preferably depending on the shape, mass, fragility and the like of the propellant. In an advantageous manner, a control device for controlling the pressure is provided. In this way, adaptation to a wide variety of propellant types can be carried out, whereby increased usability can be achieved. In addition, by increasing pressure in the expandable holding element this can be expanded and it can be contracted accordingly with decreasing pressure. It follows that a propellant module located in the module holder can be held with increasing pressure in the expandable holding element and can be released with decreasing pressure in the expandable holding element.

It is further particularly preferred when the pressure in the expandable holding element can be measured. For this purpose, different measuring devices, such as pressure sensors or barometers, can be provided. The measuring devices may be located on the module holder and/or in the holding element. Due to the pressure measurements in the holding element, continuous tests or as required different tests can be carried out, such as leak tests. Preferably, the functionality of the holding element can be checked in this way. In addition, it is conceivable that by measuring the pressure in the expandable holding element, it is checked whether a propellant or whether no propellant is being held by the module holder.

It is also advantageous if the holding element can be expanded in the radial direction, in particular in the direction of the propellant axis. In this way, a holding force acting in the radial direction, in particular in the direction of the propellant axis, can result, whereby the propellant, in particular the propellant module, can preferably be clamped in the middle of the module holder.

It is also advantageous if the propellant, in particular a propellant module, can be clamped in the module holder by means of the holding element. In this way, the propellant, in particular a propellant module, can be held reliably and safely and thus, for example, in a separation and/or joining position. In particular, by the expansion of the holding element, the pressure and thus the volume of the holding element can be increased and so, due to the rigid module holder, a clamping force can be produced between the module holder and/or the holding element and the propellant, in particular the propellant module. By expanding the expandable holding element against the propellant, in particular a propellant module, the clamping and counter-clamping may result, wherein the clamping and the counter-clamping increase with increasing pressure in the expandable holding element. In this respect, a higher holding force, in particular a higher maximum holding force, can be produced as a result of increasing pressure in the expandable holding element.

One structural design provides that the module holder has at least two holding elements, in particular three holding elements, in the radial direction, in particular along its perimeter. By providing for multiple holding elements, fixing the propellant, in particular the propellant module, can be carried out at multiple application points. In this way, a clamping and counter-clamping can be achieved by means of the holding elements. This clamping can be additionally improved by means of a third holding element. In particular, the propellant, in particular a propellant module, can be fixed in the module holder in the manner of a three-point bearing. The propellant, in particular a propellant module, can thus be gripped by the holding elements. Further, it may be provided that at least one of the expandable holding elements lifts the propellant, in particular a propellant module, off the module holder when the expandable holding element expands. Here, the arrangement of the expanding holding elements on the module holder may be designed such that the propellant, in particular a propellant module, is only in contact with the holding elements. Alternatively, or additionally, other holding elements along the perimeter of the module holder may be provided, in particular to further increase the holding force.

In structural terms, it is proposed that the holding element has at least one holding surface facing the propellant, in particular the propellant module. At the holding surface, the propellant, in particular the propellant module, can come into contact with the holding element. The surface of the holding surface may preferably be designed such that the clamping effect is increased, for example by a surface coating or surface structuring. As a surface coating, for example, coatings of rubber, plastic or any other material can be used and/or coatings from which a high coefficient of friction between the holding element and the propellant results.

The module holder may be in the form of a gripping device. In particular, the module holder may be formed in the manner of a pliers, fork or the like grasping the propellant, in particular a propellant module. The module holder may have a semicircular shape so that a holder is formed into which the propellant, in particular one or more propellant modules, can be introduced. Preferably, the module holder can at least partially grip the propellant, in particular the propellant module. Depending on requirements, the module holder may be in the form of a rigid element and/or of a movable element. A movable embodiment offers the advantage that the gripping device can first be reduced by a predetermined order of magnitude and then the remaining distance can be taken up by means of the expandable holding elements. In this way, the flexibility of the propellant portioning device can be further increased.

In this context, it has proved advantageous if the holding elements are arranged at the module holder ends, in particular the gripper ends and/or in the center of the module holder. In this way, a reliable holder of the propellant, in particular the propellant module, can be produced, in particular in the manner of a two-point or three-point bearing.

It is particularly preferred when the holding elements are arranged eccentrically. In this way, the propellant module can be subjected to a radial force, which simplifies the separation process. In particular, the separation can be carried out by means of a linear movement of the module holder and by means of the holding elements.

In structural terms, it is further proposed that the at least one holding element is in the form of an expandable cushion. The holding elements may be in the form in particular of rubber and/or fabric mats or hoses. The holding elements can also have any shape. However, it has proven to be particularly advantageous when using cuboid cushions. Particularly preferably, the material can be selected such that it can withstand high loads, in particular pressures. In particular fiber-reinforced, textile and/or polymeric materials have been found to be advantageous materials. The cushion can have a stretchable elastic shell, such as a membrane. This can support the expansion and the cushion can adapt to the shape of the ammunition body which is to be held.

A preferred embodiment provides that the holding elements can be activated for expanding individually and/or together. In particular, the holding elements can be subjected to different pressures and can thus be expanded accordingly to different degrees and/or expanded at different times. In this way, the adaptation of the propellant portioning device to the propellants to be handled and to be held, in particular propellant modules, in particular to the shape, the diameter or the like, can be further improved.

An advantageous embodiment of the propellant portioning device provides at least a second module holder. Preferably, the second module holder has at least one expandable holding element. The first module holder and the second module holder can be almost identical. However, it has proven to be particularly advantageous if the module holders are formed differently. Using the second module holder, the propellant modules from which a first propellant module is to be separated can be held, while the separation of the first propellant module can be carried out by means of the first module holder, which holds the first propellant module.

Particularly preferably, the second module holder is in the form of an elongated module holder, in particular as a type of rail, with multiple holding elements. The holding elements may be arranged on the module holder one after the other in particular in the longitudinal direction as a type of row. It has been found to be particularly advantageous if the second module holder has at least two, preferably between two and six, more preferably five, expandable holding elements. It is also advantageous if the second module holder is of a fixed form. In particular, the second module holder may, for example, be attached directly to the weapon system and/or may be spaced apart from a propellant holder which is holding the propellant. Alternatively, or additionally, each propellant module may be assigned a module holder. In particular, each propellant module may be assigned at least one expandable holding element. It is further advantageous when a common support is provided for a number of module holders. The holding elements of the module holders can preferably be activated individually and expanded as required.

A structural design provides that the module holders are designed to be movable relative to each other. Particularly preferably, at least one module holder is designed to be movable. It is particularly advantageous if the first module holder is designed to be movable and the second module holder is of a fixed form so that they can be moved relative to each other. Due to a first module holder which is designed to be movable, the advantage is that this can be moved for portioning and/or separating the propellant modules. It is particularly advantageous if the second module holder is of a fixed form. However, the invention is not limited to this. For example, embodiments are conceivable in which the second module holder can be moved, and the first module holder is of a fixed form. Also, both module holders can be designed to be movable. In particular, the module holder which is designed to be movable can be both pivoted in the radial direction and/or moved in the direction of the propellant axis. It has proven to be particularly advantageous if the module holder can be moved between different positions. Thus, the module holder can be moved back and forth between a pick-up position, a separation position, a joining position, a portioning position and/or a transfer position, for example. In this way, the module holder which is designed to be movable can grip and move the propellant module to be separated. Here, the pick-up position refers to the position in which the first module holder does not hold a propellant module and is accordingly ready for gripping a propellant module of the propellant. The propellant portioning device is located in the portioning position when the movable first module holder grips a propellant module of the propellant, and the propellant is portioned accordingly by movement of the module holders relative to each other. The transfer position is adopted once the portioned propellant module has been separated and can be transferred from the movable first module holder to a further processing component.

Preferably, for portioning a propellant composed of a plurality of propellant modules, some of the propellant modules can be held by means of the second module holder, while the first module holder performs a movement, in particular a movement in the axial direction of the propellant axis, in order to allow the separation of the propellant modules. Preferably, the propellant module can be subjected to a radial movement during this movement. In this way, an angular movement can be produced during separation, which simplifies the separation of the propellant modules.

It is particularly advantageous if the module holder center axes of the at least two module holders are arranged coaxially or offset relative to each other. Offset may mean in particular that the module holder center axes have a small offset relative to each other and/or are arranged at an angle or in parallel. Due to the offset arrangement of the at least two module holders, the advantage may result that during the portioning of the propellant in addition to the axial movement, a small radial movement with respect to the propellant axis can also take place, so that the portioning is facilitated.

It is particularly preferred when a first propellant module can be transferred from a portioning position to a transfer position by the movement of the first module holder. In this way, the propellant module to be separated can first be separated from the other propellant modules of the propellant and prepared for further handling.

One development of the invention provides that at least one module holder can be moved by means of a spindle drive. The spindle may preferably be straight and have a thread, so that by rotation a corresponding propulsion of the module holder is carried out. By the movement of the spindle, in particular a movement can be produced in the longitudinal direction and in particular towards and/or away from the second module holder. A drive, in particular an electric one, may be further provided for the rotation of the spindle.

A further advantageous embodiment provides that the propellant portioning device has a propellant holder for holding the propellant. The propellant holder may preferably be arranged such that it holds a propellant and at least one propellant module is pressed against the propellant holder by at least one holding element of a module holder. In particular, a force acting from above on the propellant against the propellant holder can be produced by means of the second module holder, whereby the propellant module can be clamped. The propellant holder may preferably be arranged in a plane parallel to the spindle and/or, for example, may be of a tub-like and/or shell-like form. For holding a propellant and for the positioning thereof in the propellant portioning device, the propellant holder may also have a positioning device, in particular a stop. Preferably, the propellant holder and the module holder and the spindle are arranged on a common frame.

In a development of the invention, a sensor for determining the position of at least one propellant module is proposed. The sensor can be used to determine the position of the propellant and/or the propellant module and/or the module holder. The sensor may preferably be embodied as an accelerometer and/or a speed sensor. Alternatively, or additionally, by means of the sensor, the positioning of the propellant and/or the propellant module and/or the type of propellant can be detected. The sensor may be in the form, for example, of a laser sensor, an infrared sensor, an ultrasonic sensor, a camera sensor or the like. Particularly preferably, there may be multiple sensors.

In addition, to achieve the previous object, a propellant handling device with a propellant portioning device is proposed. The same advantages result which have already been described in connection with the propellant portioning device. All of the features can be used alone or in combination.

It is particularly preferred when the propellant portioning device is part of a handling device which can be used, for example, for ammunitioning, de-ammunitioning, setting up or the like or for various of these operations. Preferably, the handling device may be part of a weapon system and/or a propellant magazine. Preferably, the handling device may be arranged in the ammunition flow between the propellant magazine and the weapon or else in the ammunition flow during ammunitioning and/or de-ammunitioning.

According to one embodiment of the propellant handling device, a portioned propellant module is transferred to a magazine by means of the module holder. The transfer can be carried out manually or automatically.

Particularly preferably, the handling device may additionally have an ammunition body holding device and/or a guide device to which an ammunition body holding device can be attached. For picking up and/or applying a propellant, the ammunition body holding device can preferably be pivoted around a pivot axis of the guide device and thus, for example, from a horizontal to a vertical position and vice versa. In particular, the ammunition body holding device can be moved into a position corresponding to the propellant portioning device for transferring the propellants. The transfer can be carried out in particular in a vertical and/or horizontal position. Intermediate positions are also conceivable. In addition, the ammunition body holding device can be moved along the guide device in order to bridge distances between a position behind the weapon barrel and a propellant magazine, for example, and thus to be moved to the current position of the propellant portioning device. Alternatively, or additionally, the handling device may preferably also be arranged to be movable within the weapon system.

The object is further achieved in a weapon system of the type mentioned above by a propellant handling device or a propellant portioning device of the type described above. Here, too, the same advantages as described above result, wherein all features can be used alone or in combination.

A preferred embodiment of the weapon system provides that for loading the handling device and in particular the propellant portioning device is arranged in the ammunition flow between the propellant magazine and the weapon. In this way, the weapon system can be of a fully automatic form. It is therefore not necessary to provide a number of handling devices and/or propellant portioning devices, each of which separately handles different types of propellants and/or which are arranged at different positions within the weapon system. It is further advantageous when the propellant portioning device is further arranged in the ammunition flow between one or more external propellant magazines and the weapon. In this way, propellants from external propellant magazines can also be used.

It is also advantageous when the propellant handling device and/or the propellant portioning device can be used for ammunitioning and/or de-ammunitioning. It is not necessary that separate handling devices and/or the propellant portioning device are used for the ammunitioning or de-ammunitioning, or that these activities are carried out manually. In this way, safety can be further increased.

With a method of the type mentioned above, the object is achieved in that the module holder has at least one expandable holding element, which is expanded to hold a propellant module.

Here, too, the same advantages result, which have already been described in connection with the propellant portioning device and/or the handling device and/or the weapon system. Here, too, all features can be used alone or in combination.

Preferably, by the introduction of a fluid into the holding element, a pressure is produced inside the holding element, whereby the holding element can be expanded and/or contracted.

Preferably, for portioning and/or for assembling a propellant, this can be inserted into a propellant holder. This inputting can be carried out automatically by an appropriate device or manually by a user. Further, the holder may be designed such that different types of propellants can be accommodated by the holder, in particular differing with respect to the mass and/or geometry of the propellant.

According to a preferred embodiment of the method, a first propellant module is held by means of a first module holder and at least one second propellant module is held by means of a second module holder and the propellant modules are separated from each other and/or joined together by a relative movement of the module holders. It is particularly advantageous when at least one propellant module is moved by means of a movable module holder. The propellant module to be separated can be gripped by the expansion of the expandable holding element of the movable module holder and portioned by movement of the movable module holder. The movable module holder can advantageously reach all propellant modules of a propellant held in the propellant portioning device and can grip them individually. If necessary, a number of propellant modules to be separated can be gripped, wherein in this case the propellant module closest to the separation point is preferably held by the module holder.

According to a further advantageous embodiment of the method, at least one propellant module is held by means of a particularly fixed module holder. The holding is realized by expanding at least one holding element of the fixed module holder, in that the holding element clamps the propellant module. Furthermore, at least one movable module holder can portion the propellant into individual propellant modules during holding by the fixed module holder.

In a development of the method, it is proposed that the first propellant module is moved by means of the first module holder from a portioning position to a transfer position and is transferred to a propellant magazine and/or a weapon. The movable module holder can thereby be moved from a pick-up position in which the module holder is not holding a propellant module, into a portioning position in which the movable module holder grips the propellant module to be portioned by expansion of the expandable holding elements and separates the propellant module by a relative movement, finally moving into a transfer position. The transfer can be carried out automatically or manually.

A further possibility of the advantageous design of the method provides that the separation and/or joining process is repeated with further propellant modules of the same propellant. During the portioning of a propellant, at least one propellant module of the propellant can be gripped, portioned and transferred by means of a first module holder. This process can be repeated until the entire propellant formed from a plurality of propellant modules is portioned and separated into individual propellant modules and/or joined together.

It is further advantageous when the propellant portioning device is used for joining propellants together. In this case, a propellant module can be pushed by the module holder onto at least one other propellant module located in a second module holder. This process can also preferably be repeated until a propellant formed from a plurality of individual propellant modules results.

A preferred embodiment of the method provides that the holding element is contracted to release the propellant module. In this way, the propellant module can be released again, for example in the manner of a type of handling which has been carried out, and, for example, can be moved further by a further propellant handling device. By holding the propellant module with an expanded holding element and by releasing it by contracting the holding element, the propellant module can be transported over any distance and/or held at a certain position and stored. Thus, a propellant module can be transferred, for example, to a magazine and/or a weapon and/or can be removed from a magazine.

Also, the features described on the basis of the method, the handling device or the weapon system can be used alone or in combination in the propellant portioning device described above.

BRIEF DESCRIPTION OF THE DRAWINGS

Further details and advantages of the propellant portioning device according to the invention will be explained in more detail below with the help of the attached drawings on the basis of an exemplary embodiment. In the figures:

FIG. 2.1 shows a side view of the propellant portioning device of FIG. 1 in the pick-up position;

FIG. 2.2 shows a side view of the propellant portioning device of FIG. 1 in the portioning position;

FIG. 2.3 shows a side view of the propellant portioning device of FIG. 1 in the transfer position;

DETAILED DESCRIPTION

Figure 1:
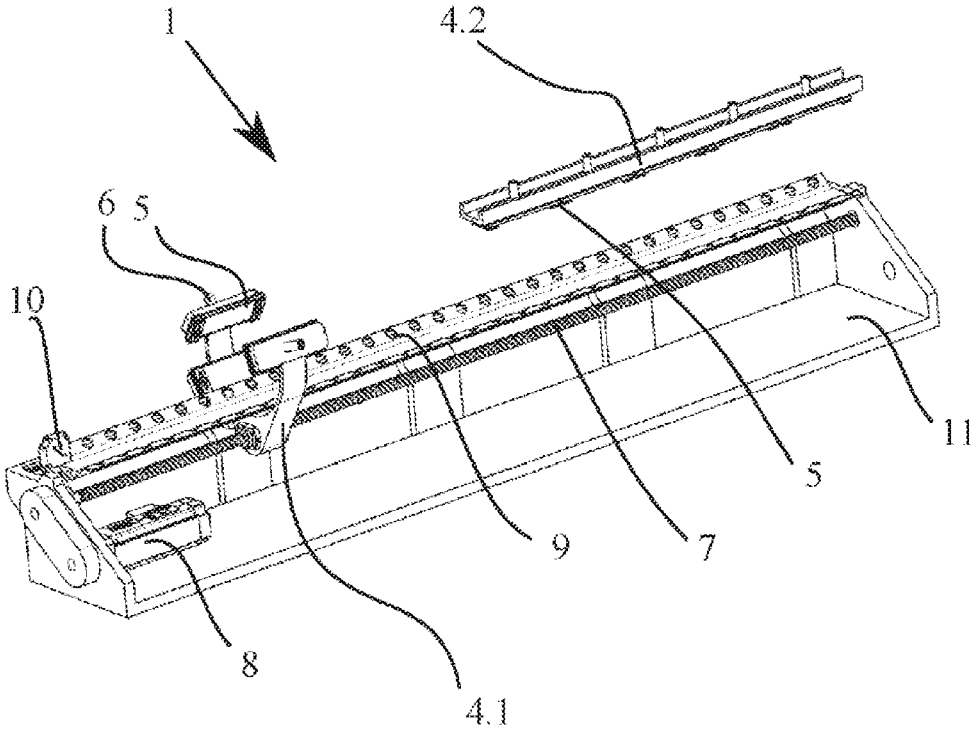
FIG. 1 shows a perspective illustration of an embodiment of the disclosed propellant portioning device comprising an expandable holding element.

In FIG. 1, a propellant portioning device 1 is shown, by means of which the most diverse types of propellant 3 can be handled reliably and safely. Corresponding propellants 3 can be used, for example, in weapon systems 13, such as in artillery guns, battle tanks or the like, in particular in the area of propellant magazine 14 and/or for ammunitioning and/or de-ammunitioning.

In appropriate weapon systems 13, a variety of types of propellants 3 are usually used, which are usually handled with different propellant portioning devices 1, each assigned to a propellant type, or manually. This is because the propellants 3 often differ in geometry, material, mass or the like. Also, propellants 3 are differently sensitive, depending on the type of outer shell or structure. The individual propellants 3 usually consist of multiple propellant modules 2, which are joined together as a type of propellant rods. Such propellants 3 can be easily damaged, in particular in case of improper pushing together or when separating the propellant modules 2. Since the propellant modules 2 are also often very firmly pushed into each other due to manufacturing tolerances, unwanted damage can occur to the outer skin of the propellant modules 2 during manual separation, which sometimes leads to the fact that these cannot be used further.

In order to now also be able to handle propellants 3 of a wide variety of types safely and reliably and in particular to be able to enable fully or partially automated handling, at least one module holder 4.1 is provided in the propellant portioning device 1 according to the invention, which has at least one expandable holding element 5 for holding the propellant 3, in particular a propellant module 2.

Therefore, a propellant portioning device 1 is provided, which can be used for different types of propellants 3 and can be used in this respect in a variety of weapon systems 13 with automated ammunition feeding.

As can be seen in particular in the detail of FIG. 1, the propellant portioning device 1 has a module holder 4.1, which is designed for holding a propellant 3 formed from a plurality of individual propellant modules 2. On the module holder 4.1, at least one expandable holding element 5 is arranged, which can be expanded to hold the propellant 3 and in particular to hold at least one propellant module 2. With the help of the holding element 5, the module holder 4.1 and in particular the propellant portioning device 1 can be adapted to various types of propellants 3, for example with regard to the diameter, the geometry of the shape, the mass or the like.

The module holder 4.1 is movably mounted on a spindle 7 and encompasses a propellant holder 9. A propellant 3 formed from a plurality of propellant modules 2 can be placed on the propellant holder 9 and kept ready for a joining and/or separation process. The module holder 4.1 can be moved along the spindle 7 axially. The spindle 7 provides for propulsion of the movable first module holder 4.1 by rotation. The module holder 4.1, the spindle 7 and the propellant holder 9 are further arranged on a frame 11, which may also have other components which are not shown in detail, such as a drive, sensors or the like. The holder 9 shown in FIG. 1 has a tub shape, but may, for example, also be designed as a U-profile, a V-profile or in another shell form.

In order for the spindle 7 to be able to rotate, a drive 8 is provided according to the illustration. The drive 8 can be operated electrically, wherein all other drive types can also be suitable here. The drive 8 is connected to the spindle 7 via a gearbox and the rotational speed of the spindle 7 is continuously controllable by means of the drive 8.

As can be seen further, the module holder 4.1 according to the present exemplary embodiment is in the form of a kind of gripping device, which has a tongs-shaped geometry overall. The module holder 4.1 is designed so as to at least partially encompass the propellant 3. The propellant 3 can be introduced into the holder opening thus formed and then held by the expanded holding element 5.

The module holder 4.1 has at least one holding element 5. However, it has been found advantageous if at least two, in particular three, holding elements 5 are arranged on the module holder 4.1, along the perimeter of the holder 4.1, i.e. in the radial direction. The holding elements 5 are spaced apart from each other, so that a two-point or three-point bearing of the introduced propellant module 2 results. The holding elements 5 are arranged in particular eccentrically, so that during a movement of the module holder 4.1 the propellant module 2 is subjected to a radial movement. Alternatively, however, for example, only one expandable holding element 5 may be provided, which is arranged at only one point or along the complete perimeter of the module holder 4.1. As is further shown in FIG. 1, the holding elements 3 are arranged at the holder ends and to the right and/or left of the center of the holder. However, the invention is not limited to this. Rather, embodiments may also be conceivable in which only one holding element 5 or another number of holding elements 5 is provided.

The propellant load module 2 is held with a holding surface of the holding element 5. The holding surface is facing the propellant module 2 and can come into contact with this. The surface of the holding surface may preferably be designed such that a clamping effect produced by the expansion of the holding element 5 is increased, for example by a surface coating or surface structuring. As a surface coating, for example, coatings of rubber, plastic or any other material can be used and/or coatings from which a high coefficient of friction between the holding element 5 and the propellant 3 results.

In order to hold the propellant module 2, the holding elements 5 can be expanded in particular by pressure of a fluid 21. The pressure in the holding element 5 can preferably be produced hydraulically and/or pneumatically. By applying pressure to the holding element 5, the holding element 5 is expanded and thus produces a holding force by contact with the propellant module 2, which holds the propellant module 2. The holding elements 5 act in particular in the radial direction, i.e. they produce a radial force in the direction of the propellant axis A.

The pressure, in turn, can be produced, for example, by means of a pressure generator 18 which is not shown in detail, such as a pump or a compressor. For this purpose, a connection 6 is provided on the holding element 5 for connecting a hydraulic and/or pneumatic line system. In this way, the fluid 21 can be fed in and out, whereby control of the pressure inside the holding element 5 is possible. For example, a high holding force can be produced by means of a high pressure and a low holding force by means of a lower pressure. By means of an adapted pressurization of the holding element 5, the holding force can be adjusted. In this way, different propellants 3 can be held reliably and without damage. Preferably, the individual connections 6 of the holding elements 5 can be activated individually, whereby the holding elements 5 can be activated together and/or separately. In order to be able to additionally check the pressures in the holding elements 5, sensors which are not shown in more detail may be provided, which measure the internal pressure of the holding elements 5. In this way, feedback can be carried out and the holding pressure can be controlled as required or a defect can be detected.

According to the present exemplary embodiment, the holding element 5 is in the form of a cushion, in particular as a high-pressure cushion, which has a cuboid shape overall. Alternatively, however, designs are possible, for example, with round, oval, tubular or other cushions. The holding element 5 may also be made of a plastic material and, for example, may have a membrane. In this way, when holding a propellant module 2 the holding element 5 can be adapted to the outer contour of the propellant module 2.

In order to now allow a separation and/or a joining together of the propellant modules 2, as FIG. 1 further shows, a second module holder 4.2 is provided. This also has at least one expandable holding element 5. The first module holder 4.1 and the second module holder 4.2 can be of almost identical form. According to the present embodiment, however, the second module holder 4.2 is in the form of an elongated module holder 4.2, in particular as a type of rail, with a number of holding elements 5. The holding elements 5 are arranged on the module holder 4.2 one after the other in particular in the longitudinal direction as a type of row. The propellant modules 2 from which a first propellant module 2 is to be separated can be held using the second module holder 4.2, while the separation of the first propellant module 2 can be carried out by means of the first module holder 4.1 which is holding the first propellant module 2.

According to the present exemplary embodiment, the second module holder 4.2 has a total of five holding elements 5 and is of a fixed form relative to the frame 11 and in particular to the module holder 4.1. In particular, the second module holder 4.2 may, for example, be attached directly to the weapon system 13 and/or may be distanced from a propellant holder 9 holding the propellant 3. The holding elements 5 of the module holders 4.1, 4.2 can preferably be activated individually and expanded as required.

The first module holder 4.1 is designed to be movable relative to the second module holder 4.2. In this way, the advantage is provided that the first module holder 4.1 can be moved for portioning and/or separating the propellant modules, whereas the second module holder 4.2 holds the remaining propellant modules 2.

Figure 3:
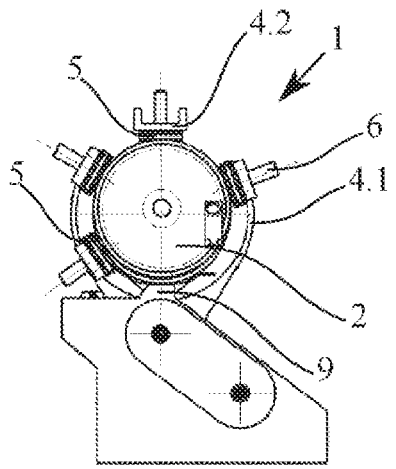
FIG. 3 shows a cross-section through the propellant portioning device of FIG. 1.

FIG. 3 shows the propellant portioning device 1 in cross-section. According to the illustration, the three expandable holding elements 5 are arranged along the tongs-shaped module holder 4.1. The expandable holding elements 5 of the second module holders 4.2 are arranged in a row, so that in this illustration only one expandable holding element 5 is visible in the upper part of the figure.

In FIG. 1, the holding elements 3 are initially contracted and not expanded. The pressure inside the holding elements 5 is rather low. In this position, the propellant portioning device 1 is ready for receiving propellant modules 2. In FIG. 3, the pressure inside the holding elements 5 and thus their volume has become greater, since the cushions as holding elements 5 have been inflated with a fluid 21, in particular compressed air, whereby the holding force is produced.

Using the illustrations in FIGS. 2.1 to 2.3, a separation process in a propellant portioning device 1 according to the invention will be explained in more detail. For a joining process, the corresponding steps can be taken analogously in reverse order.

For portioning a propellant 3, this can be positioned according to FIG. 2.1 in the holder 9 and the expandable holding elements 5 of the second module holder 4.2 can be expanded against the propellant 3. The positioning of the propellant 3 in the holder 9 can be carried out automatically by a positioning device or manually by a user. It is suitable to design the holder 9 with a positioning aid which is not illustrated, for example a stop, for easier positioning of the propellant 3. In this case, the propellant module 3 to be separated is not gripped by the holding elements 5 of the second module holder 4.2.

During the expansion of the expandable holding elements 5 of the second module holder 4.2, the propellant 3 composed of a plurality of propellant modules 2 is at least partly pressed against the holder 9, so that a clamping results between the holding elements 5 of the second module holder 4.2 and the propellant 3 and a corresponding counter-clamping results between the holder 9 and the propellant 3. The clamping and the counter-clamping can be controlled by the pressure in the expandable holding elements 5.

During the process of expansion of the expandable holding elements 5, their surface adapts to the contour of the propellant 3. Due to this adaptation, an optimal force transfer, in particular an optimal clamping, can take place between the surfaces of the expandable holding elements 5 and the propellant 3.

The movable first module holder 4.1 is meanwhile in the pick-up position, wherein the expandable holding elements 5 of the first module holder 4.1 are relaxed, consequently contracted.

For portioning, the first module holder 4.1 can be moved into the portioning position according to FIG. 2.2 by means of the spindle 7 and the drive 8. Due to the tongs-shaped embodiment, the first module holder 4.1 can be positioned so that the propellant module 2 to be portioned is located in the first module holder 4.1 after the movement.

Subsequently, the expandable holding elements 5 of the first module holder 4.1 are expanded so that the propellant module 2 to be separated is clamped in the first module holder 4.1 and the propellant module 2 is gripped. Due to a small offset of the propellant axis A or the axes of the first and the second module holders 4.1, 4.2 and the eccentricity of the holding elements 5, this gripping results in a slight bending at the connection point of the second or further propellant modules 2 and the propellant module to be portioned 2, so that the portioning of the propellant module 2 is facilitated during subsequent movement of the first module holder 4.1.

In addition, it is provided in the embodiment according to the illustration in FIG. 2.2 that one of the expandable holding elements 5 of the first module holder 4.1 is arranged on the module holder 4.1 below the propellant module to be portioned 2. By expanding this expandable holding element 5, a slight lifting of the propellant module to be portioned 2 can be achieved during gripping, so that this is lifted off from the holder 9.

If the propellant module 2 to be portioned is gripped by the first module holder 4.1 and bent slightly, the portioning of the propellant module 2 is carried out by a movement of the first module holder 4.1 along the spindle 7. During the portioning process, the remaining propellant modules 2, which are joined together for the propellant 3 and which are not to be portioned, remain fixed by the second module holder 4.2, wherein the expandable holding elements 5 remain expanded accordingly.

In the following, the first module holder 4.1 is then transferred to the transfer position shown in FIG. 2.3. Here, the holding elements 5 of the first module holder 4.1 remain expanded and the propellant module 2 is gripped accordingly. At the transfer position, the single propellant module 2 can then be transferred, for example, to the magazine 14, the weapon 15 or another ammunition body handling device 16.

Once the propellant module 2 has been transferred, the propellant portioning device 1 is again in the pick-up position. The process is then repeated, wherein that holding element 5 of the second module holder 4.2 which holds a propellant module of the propellant 3 to be portioned 2 in this portioning process is contracted, so that this can be portioned from the first module holder 4.1 in the further method. The propellant 3 can be pushed into a front position for this purpose, for example by means of a slider, in particular in the direction of the first module holder 4.1, so that the next propellant module 2 to be separated is not held by the module holder 4.2. The process is repeated until the portioning of the propellant 3 into individual propellant modules 2 is completed.

The propellant portioning device 1 further has a sensor 10, which can be used for determining the position of the propellant 3 and/or the portioned propellant module 2 and/or the movable first module holder 4.1. It may be provided to design the sensor 10 as a speed sensor and/or accelerometer. It is also conceivable to determine the type or positioning of the propellant using the sensor 10. Infrared or ultrasonic sensors or laser sensors or sensors which can process visible light are suitable as a sensor 10. Accordingly, a camera may be provided alternatively or in addition to the sensor 10.

While in the illustration the propellant 3 is portioned into individual propellant modules 2, the application of the propellant portioning device 1 is by no means limited to this. It may also be provided that the propellant 3 is portioned into pairwise composite propellant modules 2, for example. Depending on the specification, a propellant 3 can thus be portioned into two or more propellant modules 2.

Using a propellant portioning device according to the invention 1, differences between the different forms and types of propellants 3 can be compensated. Using the expandable holding element 5, which is positioned on the module holder 4.1 and/or the module holder 4.2, the different geometric propellant 3 can be held securely. The holding elements 5 can be filled independently of each other as required, in such a way that the light, filigree propellants 3 are not damaged.

Figure 4:
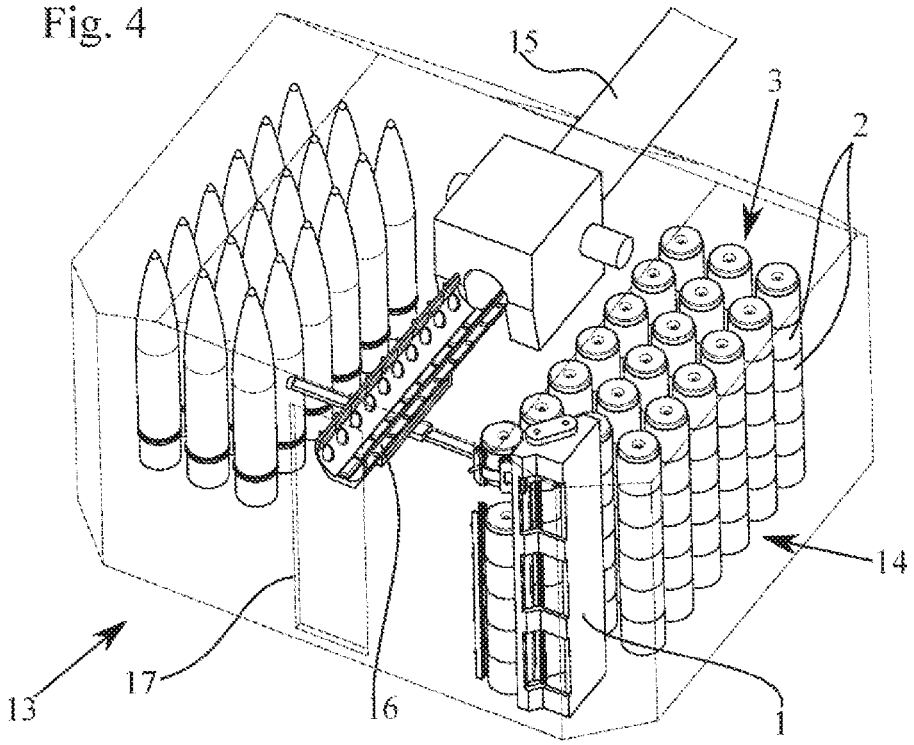
FIG. 4 shows a perspective view of a weapon system with a handling device with the propellant portioning device of FIG. 1.

The propellant portioning device 1 according to the invention can be used in a weapon system 13 shown in FIG. 4 by way of example, in particular a battle tank or an artillery gun, which has a weapon 15, in particular a barrel weapon, and a propellant magazine 14 with multiple propellants 2. The propellant portioning device 1 is part of a propellant handling device 12. The propellant handling device 12 may be arranged in the ammunition flow between the propellant magazine 14 and the weapon 15. Universal use can be carried out by adjusting by means of the expanding holding element 5. The propellant handling device 12 is used here as a loading device for feeding propellants 3 to the weapon 15.

Alternatively, or additionally, a corresponding propellant portioning device 1 can also be used for ammunitioning and/or de-ammunitioning. For this purpose, the propellant portioning device 1 may be arranged as part of a propellant handling device 12 in the ammunition flow between an external propellant magazine or an external ammunition store and an internal propellant magazine 14.

Alternatively, or additionally, a corresponding propellant portioning device 1 can also be used for ammunitioning and/or de-ammunitioning. For this purpose, the propellant portioning device 1 can be moved, for example, into the area of a hatch 17 of the weapon system 13. Now propellants 3 can be introduced from the outside into the weapon system 13, for example by means of an ammunitioning and de-ammunitioning device, as described for example in DE 10 2011 050 430 A1, or manually and can then be further processed by means of the propellant portioning device 1.

The propellant handling device 12 may also have an ammunition body holding device 16, which in particular is pivoted around a pivot axis and, for example, can be pivoted from a horizontal position into a vertical position. In particular, the ammunition body holding device 16 can be moved into a suitable position relative to the propellant portioning device 1 for transferring the propellant modules 3. The transfer can be carried out in particular in a vertical and/or horizontal position. Intermediate positions are also conceivable. In addition, the ammunition body holding device 16 can be mounted movably, for example, to bridge distances between a position behind the weapon 15 and a propellant magazine 14 and to be moved to the current position of the propellant portioning device 1. Alternatively, or additionally, the handling device 12 may preferably be arranged to be movable within the weapon system 13.

The propellant portioning device 1 has the task of separating a propellant rod 3, consisting of a number of propellant modules 2 which are joined together into individual propellant modules 2. For this purpose, the propellant rod 3 is placed on a shell 9. Here, all propellant modules 2 are clamped, except for the propellant 2 to be removed. The clamping is carried out pneumatically by means of high-pressure cushions 5, which are attached to the module holder 4.2. Subsequently, the propellant module 2 to be removed is separated from the propellant rod 2 by means of the module holder 4.1 in the form of a fork, which has a plurality of high-pressure cushions 5. The separation is carried out by means of a linear movement, in particular by means of an electric spindle drive, the module holder 4.1 and the high-pressure cushions 5, which are arranged eccentrically. The propellant module 2 is then moved to the end position. This position is measured by means of a laser sensor 10. The separation of the further propellant modules 2 is carried out analogously.

The main advantage of the device 1 is that the clamping of the propellant modules 2 by means of the holding elements 5 is force-controlled. The clamping force can be controlled via the pneumatic pressure. As a result, different types of propellant, which only allow specific radial forces, can be separated reliably and without damage. Another advantage is the fully automated functional sequence of the removal process. Using the laser rangefinder 10 in conjunction with the regulated drive of the module holder 4.1, the propellant rod 2 and then the removed propellant module 2 can be positioned precisely, so that in the further process the propellant module 2 can be conveyed further automatically. In addition, it is possible not only to separate an individual propellant module 2 but also, according to what is required, to separate a rod with two or more propellant modules 2. In this way, it is made possible to separate a propellant rod 3 in a fully automated manner and to deliver it by a reliable process to the point of use in an artillery gun or the like. In addition, it is possible, if a propellant module 2 cannot be removed, to convey the propellant 3 back again or to convey it out.

Figure 5:
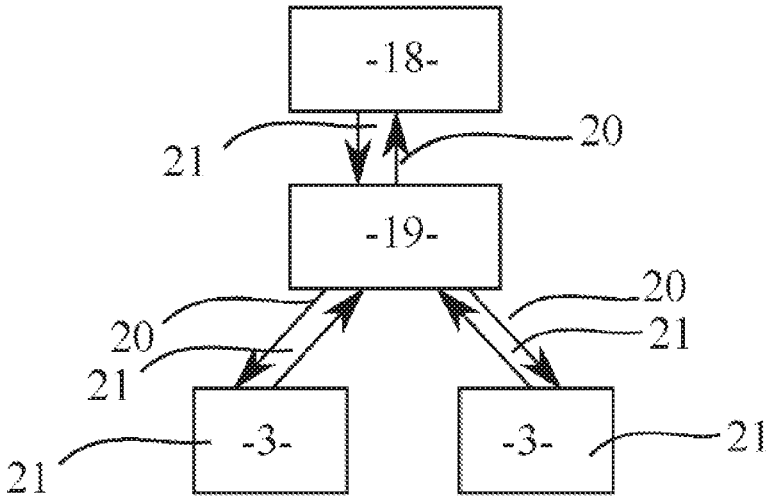
FIG. 5 shows a schematic illustration of the pressure distribution of the propellant portioning device of FIG. 1.

FIG. 5 shows schematically the pressure distribution with a pressure generator 18, for example a controllable pump. The holding elements 5 are connected to the pressure generator 18 via a line and valve system which is connected to the connections 6. The holding elements 5 are connected to the pressure generator 18 via one or more lines 20 and one or more valves 19. The pressure generator 18 can introduce a fluid 21 through the lines 20 into the interior of the holding elements 5, whereby the holding element 5 expands. Analogously, the fluid 21 can also be drained again from the holding element 5, whereby it contracts.

REFERENCE CHARACTER LIST

1 propellant portioning device
2 propellant module
3 propellant
4.1 (first) module holder
4.2 (second) module holder
5 expandable holding element
6 connection
7 spindle
8 drive
9 holder
10 sensor
11 frame
12 propellant handling device
13 weapon system
14 propellant magazine
15 weapon
16 munition body holding device
17 hatch
18 pressure generator
19 valve
20 line
21 fluid
A propellant axis

The invention claimed is:

1. A propellant portioning device for a propellant formed from a plurality of individual propellant modules, the propellant portioning device comprising:

at least a first module holder and a second module holder, wherein the first module holder and the second module holder each have at least one expandable holding element for holding one of the individual propellant modules, wherein a center axis of the first module holder and a center axis of the second module holder are offset relative to each other.

2. The propellant portioning device as claimed in claim 1, wherein each expandable holding element is expandable by a pressure of a fluid, wherein the fluid is introduced into an interior of the associated expandable holding element.

3. The propellant portioning device as claimed in claim 1, further comprising a pressure generator that produces a pressure inside each expandable holding element.

4. The propellant portioning device as claimed in claim 1, wherein a holding force of each expandable holding element is adjusted by adjusting pressurization of the expandable holding element.

5. The propellant portioning device as claimed in claim 1, wherein each expandable holding element is expandable in a radial direction in the direction of a propellant module axis.

6. The propellant portioning device as claimed in claim 1, wherein the one of the individual propellant modules is clamped in the first module holder by means of the associated expandable holding element.

7. The propellant portioning device as claimed in claim 1, wherein the first module holder has three of the expandable holding elements in a radial direction along a perimeter of the first module holder.

8. The propellant portioning device as claimed in claim 1, wherein each expandable holding element is in the form of an expandable cushion.

9. The propellant portioning device as claimed in claim 7, wherein the expandable holding elements can be activated to expand individually and/or together.

10. The propellant portioning device as claimed in claim 1, wherein the first module holder is movable and the second module holder is fixed, and the first module holder and the second module holder can be moved relative to each other.

11. The propellant portioning device as claimed in claim 10, wherein a first one of the propellant modules is transferrable from a portioning position into a transfer position by movement of the first module holder.

12. The propellant portioning device as claimed in claim 1, further comprising a propellant holder that holds the propellant.

13. The propellant portioning device of claim 1, further comprising a sensor that determines a position of at least one of the propellant modules.

14. A propellant handling device, comprising:

a propellant portioning device formed from a plurality of individual propellant modules with at least a first module holder and a second module holder, wherein the first module holder and the second module holder each have at least one expandable holding element for holding a propellant module, wherein a center axis of the first module holder and a center axis of the second module holder are offset relative to each other.

15. A weapon system with a propellant magazine and a weapon, comprising:

a propellant handling device having a propellant portioning device formed from a plurality of individual propellant modules with at least a first module holder and a second module holder, wherein the first module holder and the second module holder each have at least one expandable holding element for holding a propellant module, wherein a center axis of the first module holder and a center axis of the second module holder are offset relative to each other.

16. The weapon system as claimed in claim 15, wherein the propellant handling device is used for ammunitioning and/or de-ammunitioning of a propellant.

17. A method for portioning a propellant formed from a plurality of individual propellant modules, the method comprising:

providing a propellant portioning device having at least a first module holder and a second module holder, wherein a center axis of the first module holder and a center axis of the second module holder are offset relative to each other; and providing the first module holder with at least one expandable holding element and providing the second module holder with at least one expandable holding element, wherein the each expandable holding element is expandable to hold a first one of the individual propellant modules.

18. The method as claimed in claim 17, further comprising holding a first one of the individual propellant modules by the first module holder; and holding a second one of the individual propellant modules by the second module holder; wherein the individual propellant modules are separated from each other and/or are joined together by a relative movement of the first module holder and the second module holder.

19. The method as claimed in claim 17, further comprising producing a pressure inside the each expandable holding element by an introduction of a fluid into the associated holding element, whereby the associated expandable holding element is expanded and/or contracted.

* * * * *